US008422709B2

(12) United States Patent
Nordahn et al.

(10) Patent No.: US 8,422,709 B2
(45) **Date of Patent: *Apr. 16, 2013**

(54) METHOD AND SYSTEM OF NOISE REDUCTION IN A HEARING AID

(75) Inventors: Morten Agerbaek Nordahn, Bronshoj (DK); Carsten Paludan-Muller, Olstykke (DK)

(73) Assignee: Widex A/S, Lynge (DK)

( * ) Notice: Subject to any disclaimer, the term of this patent is extended or adjusted under 35 U.S.C. 154(b) by 1166 days.

This patent is subject to a terminal disclaimer.

(21) Appl. No.: 12/201,544

(22) Filed: Aug. 29, 2008

(65) Prior Publication Data

US 2008/0317268 A1 Dec. 25, 2008

Related U.S. Application Data

(63) Continuation-in-part of application No. PCT/EP2007/051890, filed on Feb. 28, 2007.

(60) Provisional application No. 60/778,376, filed on Mar. 3, 2006.

(30) Foreign Application Priority Data

Mar. 3, 2006 (DK) ..... 2006 00318

(51) Int. Cl.
*H04R 25/00* (2006.01)

(52) U.S. Cl.
USPC ..... 381/321; 381/312; 381/317

(58) Field of Classification Search ..... 381/312–331
See application file for complete search history.

(56) References Cited

U.S. PATENT DOCUMENTS

| | | | | |
|---|---|---|---|---|
| 5,033,090 | A * | 7/1991 | Weinrich | 381/318 |
| 6,275,596 | B1 * | 8/2001 | Fretz et al. | 381/321 |
| 2005/0013456 | A1 | 1/2005 | Chalupper | |

FOREIGN PATENT DOCUMENTS

| | | | |
|---|---|---|---|
| EP | 1689210 | A2 | 8/2006 |
| JP | 2000102098 | A | 4/2000 |
| WO | 2005051039 | A1 | 6/2005 |
| WO | 2006/118819 | A2 | 11/2006 |
| WO | 2007045271 | A1 | 4/2007 |

OTHER PUBLICATIONS

Japanese OA for JP2008545022 Jul. 5, 2011 with English translation.
D. A. Preves et al, "A Feedback Stablilizing Circuit for Hearing Aids", Hearing Insttruments, Harcourt Brack Jovanovich Publishing, Duluth, Minnesota, US, vol. 37, No. 4, Apr. 1986, pp. 34, 36-41, 51 XP000796174.
American National Standard—Methods for the Calculation of the Articulation Index—ANSI S3.5—1969.

(Continued)

*Primary Examiner* — Duc Nguyen
*Assistant Examiner* — Matthew Eason
(74) *Attorney, Agent, or Firm* — Sughrue Mion, PLLC

(57) ABSTRACT

A hearing aid (200) comprises at least one microphone (210), a signal processing means (220) and an output transducer (230). The signal processing means is adapted to receive an input signal from the microphone. The signal processing means is adapted to apply a hearing aid gain to the input signal to produce an output signal to be output by the output transducer, and the signal processing means comprises means for adjusting the hearing aid gain by a direct transmission gain calculated for the hearing aid. The invention further provides a method and a system for reducing noise, as well as a computer program product.

18 Claims, 4 Drawing Sheets

OTHER PUBLICATIONS

American National Standard—Methods for Calculation nof the Speech Intelligibility Index—ANSI S3.5—1997.

Francis Kuk et al, "Fitting Tips: How Do Vents Affect Hearing Aid Performance", Hearing Review, Feb. 2006.

* cited by examiner

METHOD AND SYSTEM OF NOISE REDUCTION IN A HEARING AID

RELATED APPLICATIONS

The present application is a continuation-in-part of application no. PCT/EP2007/051890 filed on Feb. 28, 2007 and published as WO-A1-2007099115, the contents of which are incorporated herein by reference. The present application claims the benefit of application PA200600318, filed on Mar. 3, 2006 in Denmark, the contents of which are incorporated herein by reference. The present application claims the benefit of U.S. Provisional Patent Application Ser. No. 60/778,376, filed Mar. 3, 2006, the contents of which are incorporated herein by reference.

BACKGROUND OF THE INVENTION

1. Field of the Invention

The present invention relates to the field of hearing aids. The invention, more specifically, relates to hearing aids utilizing noise reduction techniques. The invention further relates to methods for adjusting the hearing aid gain for noise reduction. In addition the invention relates to a system of reducing noise in a hearing aid.

Hearing aids are adapted for providing at the users eardrum a version of the acoustic environment that has been amplified according to the users prescription. This is normally achieved by providing a device with a microphone, an amplifier and a miniature loudspeaker situated in an earpiece placed in the users ear canal. It is well known that there may be acoustic leaks around the earpiece. There may e.g. be a non-sealed fit or there may, for considerations about user comfort, be a vent deliberately arranged in the ear piece for relieving the sound pressure created by the users own voice. Such leaks may cause a loss in sound pressure and they may allow sound to bypass the hearing aid to reach the ear drum.

2. Description of the Related Art

PCT application PCT/EP2005/055305, published as WO-A1-2007/045271, titled "Method and system for fitting a hearing aid", the contents of which are incorporated herein by reference, provides a method for estimating otherwise unknown functions such as the vent effect and the direct transmission gain for an in-situ hearing aid. The vent effect estimate is used for correcting the in-situ audiogram and the hearing aid gain.

WO-A1-2005/051039 provides a dynamic speech enhancement technique, where speech intelligibility in noise is improved by optimizing a speech intelligibility index; such as SII (see also Methods for Calculation of the Speech Intelligibility Index: ANSI S3.5-1997), AI (see also American National Standard Methods for the Calculation of the Articulation Index; ANSI S3.5-1996). Noise reduction techniques, where speech intelligibility in noise is improved by optimizing a speech intelligibility index, increase or decrease the gain in selected frequency bands, taking into account human auditory masking.

The sound input to the hearing aid user is a combination of the sound amplified according to the hearing aid gain together with the direct transmitted sound. As long as the amplified sound dominates the direct transmitted sound in all frequency bands, the noise reduction techniques will provide good results. Noise reduction according to the state of the art to enhance SII is based on an assumption that the earplug provides a tight fit between the earplug and the ear canal. However a ventilation canal or a leakage path allows for the sound to be directly transmitted into the ear. Thus, at a certain threshold the sound input to the hearing aid user may be dominated by the direct transmitted sound, so that a decrease of the hearing aid gain will not affect the sound input to the user. If the direct transmitted sound is not taken into account, the speech intelligibility may suffer as a consequence.

Therefore, acoustic effects of the ventilation canal and possible leakage paths between the hearing aid and the ear canal are still challenges in today's hearing aid fitting strategies.

Thus, there is a need for improved hearing aids as well as improved techniques for implementing noise reduction in hearing aids.

SUMMARY OF THE INVENTION

It is therefore an object of the present invention to provide hearing aids and methods of processing signals in a hearing aid taking in particular the mentioned requirements and drawbacks of the prior art into account.

It is in particular an object of the present invention to provide a hearing aid and a respective method providing a noise reduction technique that take the relative amount of directly transmitted sound through the vent into account.

It is a further object of the present invention to provide a hearing aid and a respective method providing a SII optimization where speech intelligibility in noise is improved.

The invention, in a first aspect, provides a hearing aid comprising at least one microphone, a signal processing means and an output transducer, wherein said signal processing means is adapted to receive an input signal from the microphone, wherein said signal processing means is adapted to apply a hearing aid gain to said input signal to produce an output signal to be output by said output transducer, and wherein said signal processing means further comprises means for calculating a direct transmission gain for the hearing aid and for adjusting said hearing aid gain according to said direct transmission gain.

This hearing aid with means for adjusting the hearing aid gain according to a direct transmission gain gives a knowledge about the amount of directly transmitted sound and provides information about how much a certain frequency band may be attenuated before the direct sound becomes dominant over the amplified sound.

According to other aspects of the present invention, the hearing aid and the method are capable of incorporating knowledge of the amount of direct sound into the applied noise reduction algorithm, which thereby is optimized taking the knowledge of vent effect and leakage into account. This provides a more accurate and effective noise reduction than would be otherwise obtainable.

According to another aspect of the present invention, there is provided a hearing aid that is capable of avoiding phase disruption in the output signal by taking the direct transmitted sound into account when calculating the hearing aid gain to produce the output signal.

The invention, in a second aspect, provides a method of reducing noise in a hearing aid comprising at least one microphone producing an input signal, a signal processing means producing an output signal from said input signal, and an output transducer outputting said output signal, wherein said method comprises: calculating a direct transmission gain calculated for said hearing aid and its user; storing said transmission gain in a memory of said hearing aid; and applying a hearing aid gain to said input signal to produce said output signal, wherein said hearing aid gain is adjusted by said direct transmission gain so that said hearing aid gain is not set to a value below said direct transmission gain.

According to still another aspect of the present invention, there is provided a method of determining direct transmitted sound in a hearing aid which comprises the steps of estimating an effective vent parameter for the hearing aid, and calculating a direct transmission gain based on the effective vent parameter.

The methods provided enable a calculation of the direct transmission gain once when fitting the hearing aid which may then be used according to further methods and systems according to the present invention for the dynamic correction of also other hearing aid parameters than gain.

It may be seen as a true advantage that the hearing aids, systems and methods according to the present invention provide the ability to dynamically adjust the applicable speech intelligibility index gain and the resulting noise reduced hearing aid gain for the direct transmission gain in real time and, thus, the amount of gain that the hearing aid or system may apply at any given instance.

According to an embodiment of the present invention the hearing aid is able to adjust the hearing aid gain in each frequency band based on the instantaneous gain level, the further SII input parameters and the direct transmission gain in order to improve the overall speech intelligibility. This offers a new approach according to which the direct transmission gain is taken into account in the noise reduction technique, giving the user a better speech intelligibility in noise.

The invention, in a third aspect, provides a system of reducing noise in a hearing aid, comprising at least one microphone producing an input signal, a signal processing means producing an output signal from said input signal, and an output transducer outputting said output signal, said system comprising: means for calculating a direct transmission gain calculated for said hearing aid and its user; means for storing said transmission gain in a memory of said hearing aid; and means for applying a hearing aid gain to said input signal to produce said output signal, wherein said hearing aid gain is adjusted by said direct transmission gain so that said hearing aid gain is not set to a value below said direct transmission gain.

The invention, in a fourth aspect, provides a computer program and a computer program product A computer program product containing a computer readable medium with executable program code which, when executed on a computer, executes a method of reducing noise in a hearing aid comprising at least one microphone producing an input signal, a signal processing means producing an output signal from said input signal, and an output transducer outputting said output signal, wherein said method comprises: calculating a direct transmission gain calculated for said hearing aid and its user; storing said transmission gain in a memory of said hearing aid; and applying a hearing aid gain to said input signal to produce said output signal, wherein said hearing aid gain is adjusted by said direct transmission gain so that said hearing aid gain is not set to a value below said direct transmission gain.

Further specific variations of the invention are defined by the further claims.

Other aspects and advantages of the present invention will become more apparent from the following detailed description taken in conjunction with the accompanying drawings which illustrate, by way of example, the principles of the invention.

BRIEF DESCRIPTION OF THE DRAWINGS

The invention will be readily understood by the following detailed description in conjunction with the accompanying drawings, wherein like reference numerals designate like structural elements, and in which.

DETAILED DESCRIPTION

Figure 1A:
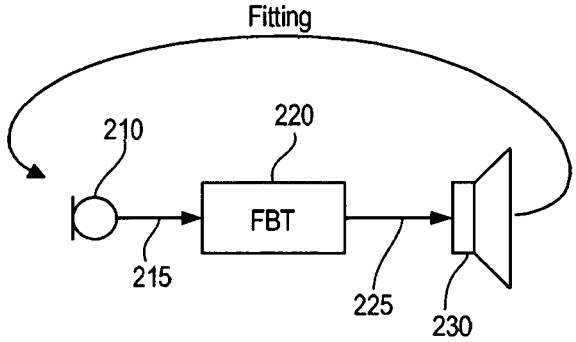
FIG. 1*a* depicts a schematic diagram regarding calculation of the direct transmitted sound.

Reference is first made to FIG. 1*a* for an explanation regarding calculating the DTG. The calculation of the DTG is done by performing a feedback test (FBT) as schematically illustrated in FIG. 1*a*. Then, the in-situ vent effect is estimated and the DTG is calculated from the vent effect. Document WO-A1-2007/045271 (mentioned above) describes this in detail.

Figure 1B:
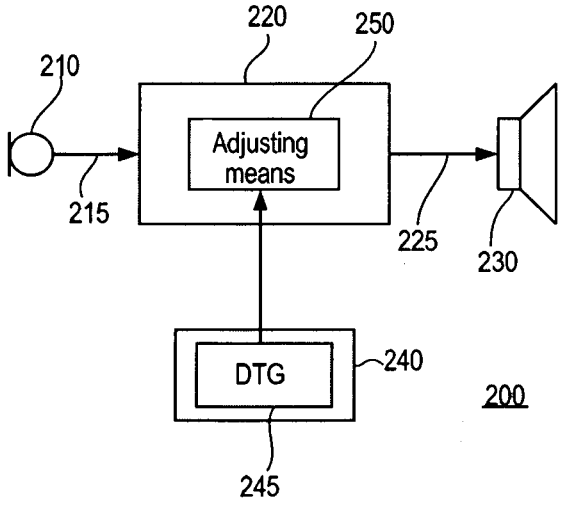
FIG. 1*b* depicts a block diagram of a hearing aid according to the present invention.

Reference is now made to FIG. 1*b*, which shows a hearing aid 200 according to the first embodiment of the present invention.

The hearing aid comprises an input transducer or microphone 210 transforming an acoustic input signal into an electrical input signal 215, and an A/D-converter (not shown) for sampling and digitizing the analogue electrical signal. The processed electrical input signal is then fed into signal processing means 220, which includes an amplifier with a compressor for generating an electrical output signal 225 by applying a compressor gain in order to produce an output signal suitable for compensating a hearing loss according to the users requirements. The compressor gain characteristic is, according to an embodiment, non-linear to provide more gain at low input signal levels and less gain at high signal levels. The signal path further comprises an output transducer 230, i.e. a loudspeaker or receiver, for transforming the electrical output signal into an acoustic output signal.

The compressor operates to compress the dynamic range of the input signals. It is useful for treatment of presbyscusis (loss of dynamic range due to haircell-loss). Actually, compressing hearing aids often apply expansion for low level signals, in order to suppress microphone noise while amplifying input signals just above that level. The compressor may also include a soft-limiter in order to limit maximum output level at safe or comfortable levels. The compressor has a non-linear gain characteristic and, thus, is capable of providing less gain at higher input levels and more gain at lower input levels. Hearing aids embodying a compressor in the signal processor are often referred to as non-linear-gain or compressing hearing aids.

The signal processing means further comprises memory 240 and adjusting means 250 for adjusting the hearing aid gain further over what the processor basically decides based on the users hearing deficit and the prevailing sound environment. This further adjustment is intended to take into account certain effects of sounds bypassing the hearing aid, e.g. by bypassing the earpiece or by propagating through the vent, as will be explained below.

For the sake of computations, the sound bypassing the hearing aid is expressed in terms of direct transmission gain (DTG). The direct transmission gain (DTG) is defined as the sound pressure at the ear drum that is generated by an acoustic source outside the ear relative to a sound pressure at the exterior vent opening generated by the same source. The direct transmission gain is typically less than one, i.e. the log value expressed in dB, will normally be a negative number. However, as there is a natural Helmholz resonance by an earpiece placed in an ear canal there will be frequencies where the DTG is above one, i.e. the log value is a positive number. Information about the direct transmitted sound in respective frequency bands can be estimated by methods to calculate a direct transmission gain for the hearing aid gain used by a certain user as those described in the document WO-A1-2007/045271.

The DTG 245 calculated for the hearing aid as a set of frequency dependent gain values is stored in memory 240 of the hearing aid. The DTG is then used by the adjusting means 250 to adjust the hearing aid gain in order to reduce noise, avoid phase disruption or provide any other useful optimization or improvement of the signal quality in the combined acoustic signal on the ear drum resulting from the amplified output signal and the direct transmitted sound.

Figure 2:
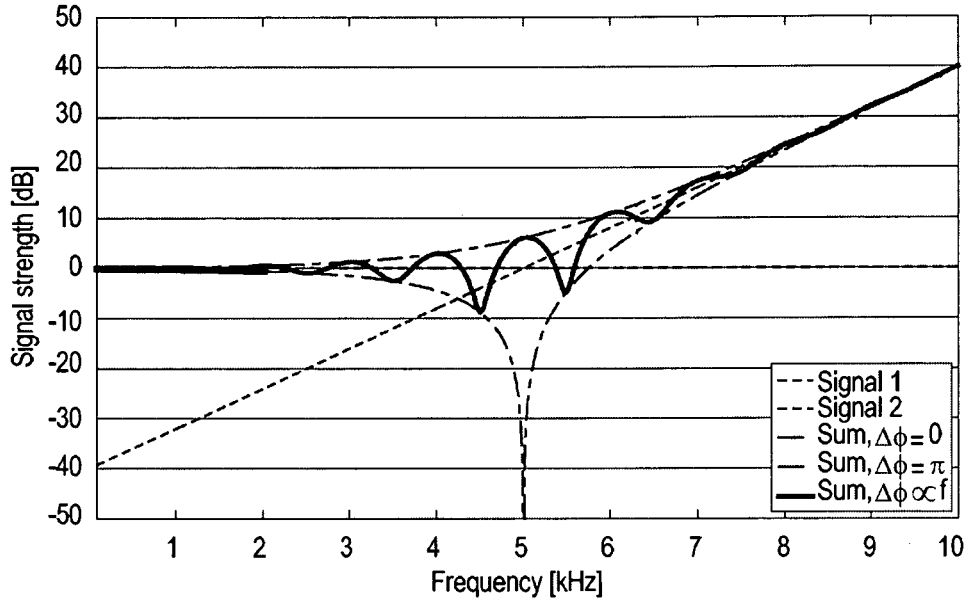
FIG. 2 depicts the level of signal versus frequency that results by adding contributions of two sound signals.

Reference is now made to FIG. 2, which depicts the level of signal versus frequency that results by adding contributions of two sound signals, and more specifically shows two frequency dependent signals with a relative phase which are added here, to clarify the principle of adding two sound signals at the eardrum. The black dotted lines are the magnitude of the two signals. The gray dash-dotted line represents the sum of these signals, when the two signals are in phase for all frequencies (upper curve), and when they are out of phase for all frequencies (lower curve), respectively. The full line shows what happens, if the phase difference varies linearly with frequency.

The sound level at the eardrum of the user is a superposition of the unaided direct sound and the sound amplified by the hearing aid. The interference of the two sound sources may lead to phase disruptions, i.e. fluctuations in the sound input, at frequencies where the unaided direct sound and the amplified sound from the hearing aid have about the same magnitude but has opposite phase. This general phenomenon is illustrated in FIG. 2, which illustrates the addition of two signals with differing magnitude and phase.

At a certain frequency, the sum of two harmonic signals can be written as $$A_1 \cos(2\pi ft+\phi_1)+A_2 \cos(2\pi ft+\phi_2) \quad (1)$$

In our example, $A_1=1$, $\phi_1=0$ and $A_2 \propto f$. $\phi_2$ is either 0, $\pi$ or $\propto f$. With simple calculations, both constructive and destructive interference can be made clear, whereas the sum of two signals with frequency dependent phase and amplitude is more complex to describe analytically. In this case, the resulting phase disruption will depend on the amplitudes and phases of the signals. However, since constructive and destructive interference constitutes the upper and lower limit of the phase disruption, respectively, we know, that a phase disrupted signal lies somewhere in between these lines, as shown in FIG. 2 for the case $\phi_2 \propto f$. It is to be noted that the ratio of the absolute amplitude corresponds to the difference of the amplitudes in dB, since dB is calculated as 20 log 10(A). An amplitude of 0 thus corresponds to $-\infty$ dB.

The lower dash-dotted gray line shows that in case the two signals with the exact same amplitude are out of phase by $\pi$, the total signal cancels out and becomes infinitely small. This is called destructive interference or phase cancellation. On the other hand, if the two signals are in phase at all frequencies, the amplitudes simply add up in a constructive interference, and gives 6 dB more sound pressure at the frequency where the two signals have the same amplitude, which can be seen in the upper dash-dotted gray line at 5 kHz. These two cases, however, are rarely met with respect to the hearing aid sound and the direct sound, since both have a varying frequency dependent phase. The black line therefore exemplifies how the total sound pressure might look like, if the relative phase depends linearly on frequency. Note, that at some frequencies, constructive interference increases the magnitude of the total signal, whereas for other frequencies, destructive interference diminishes the total signal. Since the signals do not cancel out as such at frequencies where the relative phase is almost $\pi$ and the relative amplitude is not quite 1, this phenomenon is called phase disruption.

The above example is general, and can be extrapolated to the situation in a users ear, where the amplified sound and the direct sound superpose. This in turn means that the amplified sound has to exceed a certain level before the total sound pressure at the eardrum remains unperturbed by the direct sound with respect to phase disruption. Maintaining the hearing aid gain at a similar magnitude to the direct sound would result in an increased risk of phase disruption, which is avoided with the current invention.

As is observed in FIG. 2, the difference in amplitude between the amplified sound and the unaided direct sound must be higher than a certain amount (a safety margin) to minimize phase disruption. Thus there is a lower threshold for the gain setting, equal to the directly transmitted gain +k, as suggested by the scale in FIG. 4 to the right. The safety margin is the factor k, which in principle could be set to anything. If k is negative and numerically large, the interaction between direct and amplified sound is neglected and nothing extraordinary is ever done to take the interaction into account. If k is large and positive, measures are taken all the time, which is also not optimal. Choosing the factor k is therefore a trade-off between minimizing the risk of phase disruption and limiting the SII-optimization.

Figure 3:
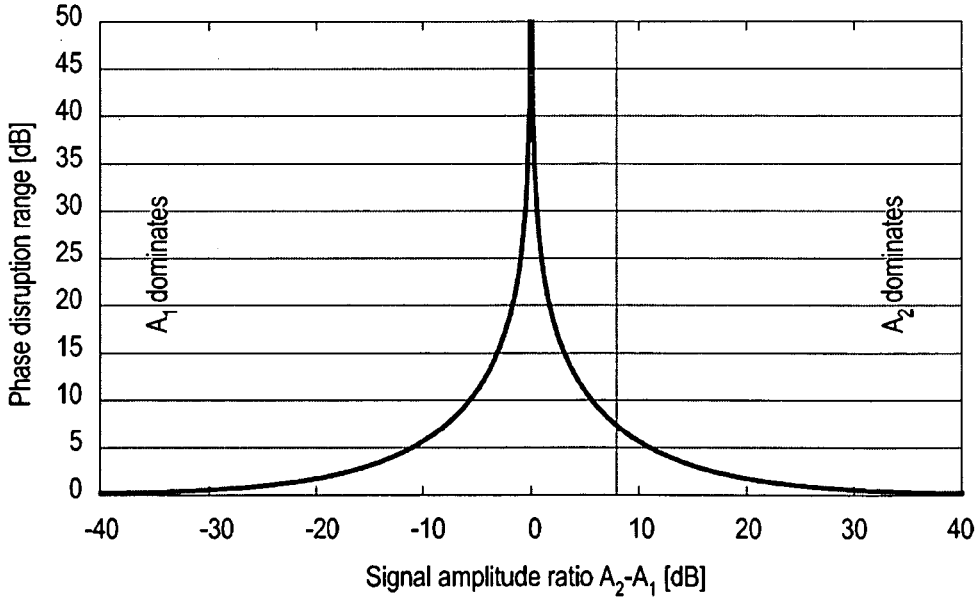
FIG. 3 depicts the phase disruption range as a function of the difference between the amplitude of the two signals.

FIG. 3 shows the phase disruption range versus signal amplitude ratio. FIG. 3 more specifically shows the difference in dB between the amplitude of the in-phase summed signal and the out-of-phase summed signal as a function of the difference between the amplitudes of the two signals shown in FIG. 2. The curve thus shows the uncertainty or possible spread of the total sound pressure due to phase disruption. The signal amplitude ratio in dB is the difference between the hearing aid sound (expressed in terms of gain) and the directly transmitted sound (expressed in terms of gain) in each band, i.e. HA-DTG (Direct Transmitted Gain) in dB, i.e. $A_1$ is DTG and $A_2$ is HA. Note, that the DTG is fixed once the earplug is made, whereas the hearing aid gain may change with the sound input. The hearing aid sound is thus the only variable, once the vent has been chosen.

For example it may be read from the curve that if one signal is 10 dB larger than the other, the phase disruption may in a worst case scenario cause the amplitude of the summed signal to vary up to −5 dB from the in-phase summed signal. Values from 1 and upward are applicable, preferably between 5 and 15 dB. Of course, a value of about 1 dB would incur a high risk of phase disruption. A value of k=7 or k=8 gives a phase disruption range of about +−3 dB, which may be considered acceptable.

If the hearing aid was turned off, the sound from the hearing aid would be $-\infty$ (completely silent), obviously meaning that the DTG would dominate totally. This would correspond to $-\infty$ on the x-axis in FIG. 3, which gives no phase disruption problems, as we would expect. On the contrary, if the hearing aid gain is e.g. 60 dB and the direct transmitted sound −10 dB, the direct sound is negligible in comparison, and no phase disruption is risked. It is only when the sound level of the direct sound and the hearing aid sound are comparable ($A_2 \approx A_1$), that the strength of the summed signal may vary significantly as indicated in FIG. 3.

Thus, in the current invention, the factor k, which is indicated as an example in FIG. 3, constitutes a lower limit, below which the hearing aid gain should not be set during the optimization process, without risking a large amount of phase disruption.

Information about the direct transmitted sound in the single frequency bands can be estimated by e.g. the methods described in the document WO-A1-2007/045271 to calculate a direct transmission gain for the hearing aid gain used by a certain user. This knowledge will then be used to optimize SII. If the direct sound e.g. dominates the lowest band, it is possible to find a new optimum for SII by changing the gain in some of the bands where the amplified sound dominates.

According to an embodiment, the adjusting means is a means for optimizing a speech intelligibility index (SII) by applying a respective noise reduction technique taking the DTG into account to give the user a better speech intelligibility in noise, as will now be described in detail.

Figure 4:
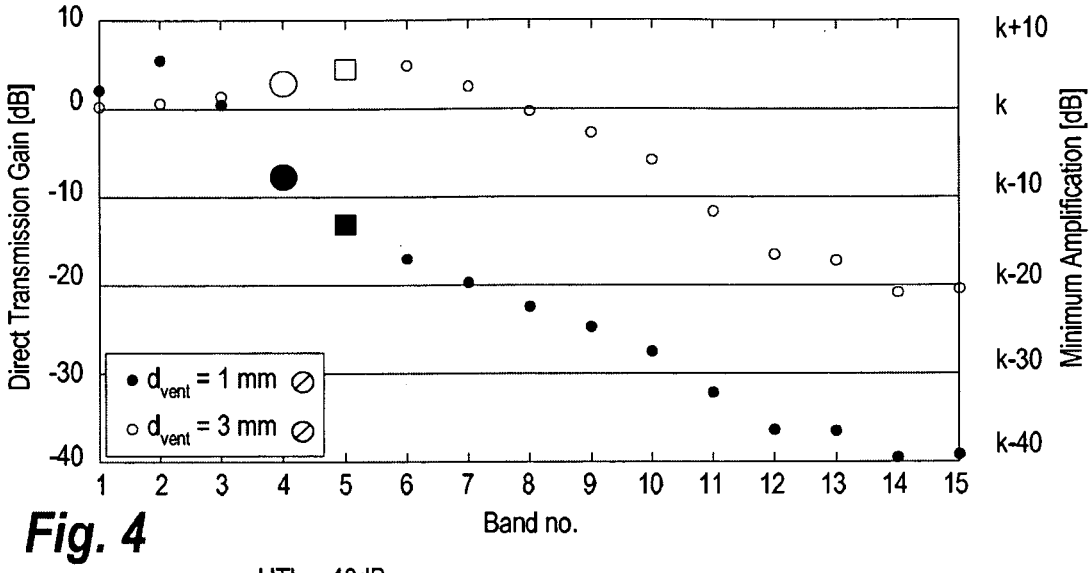
FIG. 4 shows a graph of the directly transmitted sound versus frequency.
Figure 5:
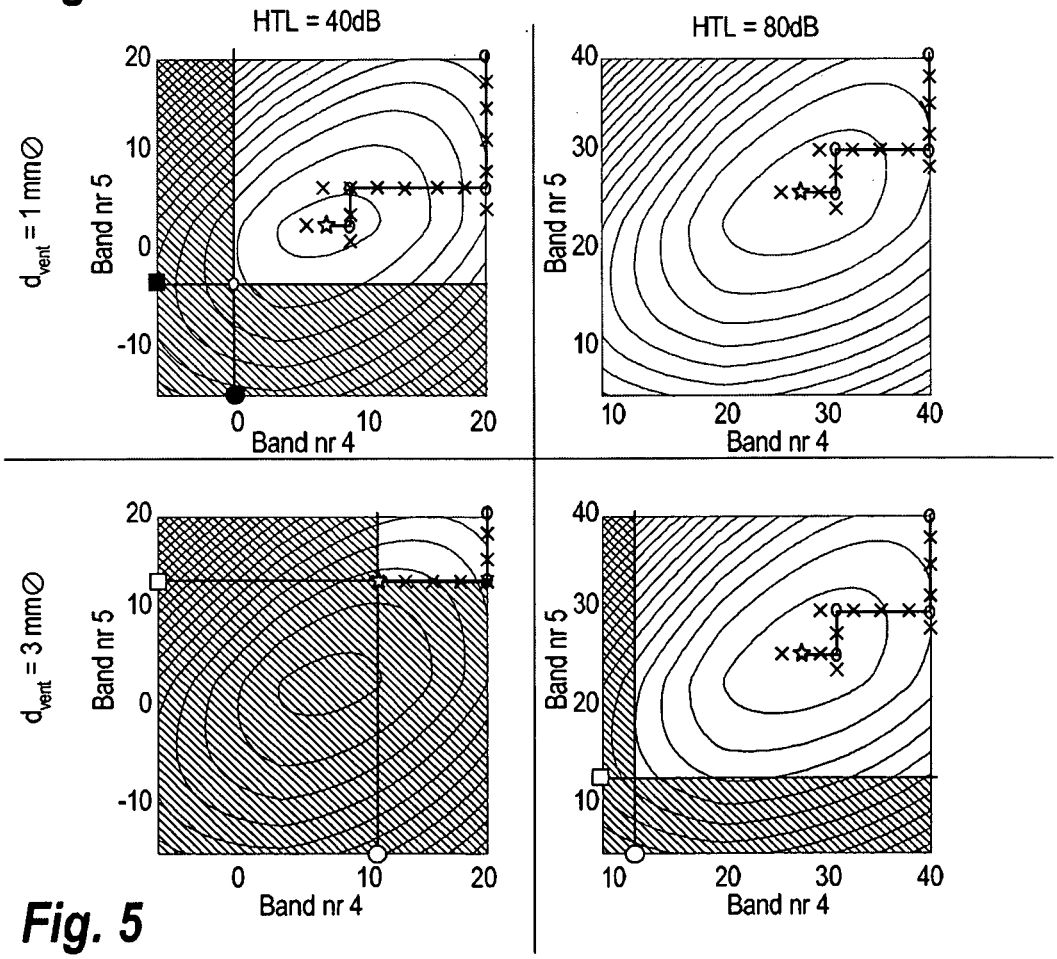
FIG. 5 shows diagrams illustrating the principle of optimizing the SII (Speech Intelligibility Index) taking into account the directly transmitted sound, according to the present invention.

The FIGS. 4 and 5 show the principle in the combination of SII (Speech Intelligibility Index)—based noise reduction technique and the directly transmitted sound through the vent.

The FIG. 4 shows the directly transmitted sound in dB. This gain function, called the direct transmission gain, represents the sound pressure at the eardrum relative to the sound pressure at the entrance of the vent by a sound source external to the ear. The direct transmission gain may be determined during the feedback test, as in the above-mentioned WO-A1-2007/045271.

The values in this example are calculated for 15 frequency bands between 100 Hz and 10 kHz. The figure has two y-scales, where the left represents the direct transmission gain, and the right represents a minimal amplification, which the hearing aid gain must exceed in order to dominate the total sound at the eardrum. The minimum amplification is determined as the hearing aid gain necessary to avoid the risk of phase disruption problems caused by adding two sound pressures of same magnitude but opposite phase. Such phase disruption results in bad sound quality, which may be described as metallic or raspy, at the frequencies in which phase disruption occurs.

The letter k in these figures refers to a limit in dB where the amplified sound is large enough to dominate the total sound pressure at the eardrum relative to the direct sound. k is a limit that divides the action of the algorithm into two states: one, where actions need to be taken to avoid phase disruption, and one where no action is needed. If the amplified sound-k is less than the direct sound, there is a risk of phase disruption, and something must be done. See FIG. 3 for clarification on the k-factor. In the FIG. 4 the direct transmission gain and the minimum amplification is emphasized for frequency band 4 and frequency band 5 for an estimated vent diameter of 1 mm (dark color) respectively 3 mm (light color).

In the diagrams of FIG. 5, the minimum amplification for k=8 dB for the two frequency bands are marked on the graphs, containing the hearing aid gain adjustment necessary to find the optimum gain setting with regards to speech intelligibility. These graphs show how the direct transmission gain interacts and interferes with the hearing aid gain in the search for the optimum gain setting with regards to the SII.

The graphs illustrate how the SII varies as a function of the hearing aid gain for two frequency bands, with a given vent diameter and hearing loss. The SII is illustrated as contour curves. The SII varies between 0 and 1. It is approximately monotonous though it may have some local minima or maxima. By varying the gain in one or more frequency bands an optimum setting of the gain in each frequency band is determined leading to an optimum SII for the hearing aid.

The diagrams in FIG. 5 illustrate the gain for a frequency band 4, having a center frequency of 500 Hz, and for a frequency band 5, having a center frequency of 634 Hz. The contour curves show how the SII is a function of the setting of the gain in each frequency band.

The SII optimization according to the prior art does not presently take the direct sound arriving through e.g. the vent into account. However, the direct sound adds to the hearing aid amplified sound and thus in practice it will not be possible to obtain a gain lower than the gain originating from the direct sound. The presence of a large vent in the ear mould in combination with a relatively mild hearing loss may thus imply that only the direct sound is heard, since it might overwhelm the amplified sound.

A further explanation on how SII is used for noise reduction in a hearing aid is found in WO-A-2005/051039, the contents of which, are incorporated herein by reference.

The diagrams in FIG. 5 also illustrate and exemplify the actual interval of the gain when k has been chosen to 8 for each of the frequency bands 4 and 5, for two vent diameters (1 mm$^{\varnothing}$ and 3 mm$^{\varnothing}$) in combination with two hearing losses (flat 40 dB HL and flat 80 dB HL).

The optimization of the SII in the hearing aid is performed in all bands, i.e. 15 dimensions in this example. However, illustrating an optimization procedure in 15 dimensions rather impedes than facilitates an easily understandable visualization of the principle. The diagrams in FIG. 5 are therefore limited to illustrate a way of optimizing the SII in two selected bands (bands 4 and 5). In the example of a linear optimization method the gain for frequency band 4 is kept constant and the gain of frequency band 5 is varied in steps until an optimum SII for that setting has been detected, then the gain of frequency band 4 is varied and the previously detected optimum setting of frequency band 5 is kept constant until an optimum setting of frequency band 4 has been detected.

The diagrams in FIG. 5 illustrate an optimization procedure where the optimization is continued until it is not possible to obtain a better SII. Naturally other optimization methods can be implemented, as long as the method takes the direct sound into account. The contour plot shows the SI-index as a function of the absolute gain in each band. The theoretical optimum, i.e. when it is assumed that the sound at the eardrum is provided only by the hearing aid, is easily detected as an 'island' in the plot. However, the direct sound (plus k), which is illustrated on the axes by use of the same symbols as in the top plot, influences not only whether that optimum is attainable or not, but also the path leading to the optimum. The gray area illustrates a region, which would be counterproductive to enter. The iterative optimization process, which could be performed in many ways, is here illustrated as a sequential adjustment of each band. A star indicates the result of the optimization method.

In the graph (upper right pane) for a severe hearing loss (HTL 80 dB) combined with a small vent (1 mm), no changes occur to the optimum parameter setting resulting in the optimum SIT when the minimum amplification is taken into consideration, compared to the conventional optimum parameter setting where the gain can be varied in the entire area. In contrary, a large vent (3 mm) and a mild hearing loss (HTL=40 dB) may allow enough direct sound to enter through the vent to influence or even dominate the total sound pressure at the eardrum (lower left pane), such that the optimum gain setting of the frequency bands is quite different when the minimum amplification is used to limit the gain settings of the frequency bands, than if the frequency bands are varied without taken this into account. In such cases this would lead to a much better parameter setting of the gain in the various frequency bands.

Therefore the iterative optimization path may be different from what would otherwise be carried out, and the optimum parameter setting may also be different from what would else be determined as optimum according to other embodiments.

A main advantage for the present invention is therefore that the SII is optimized under consideration of the actual in-situ acoustic surroundings.

It is evident for the person skilled in the art that the shown iterative path may vary greatly from a real iterative path, both due to the optimization method and to the fact that optimization occurs in all bands.

Figure 6:
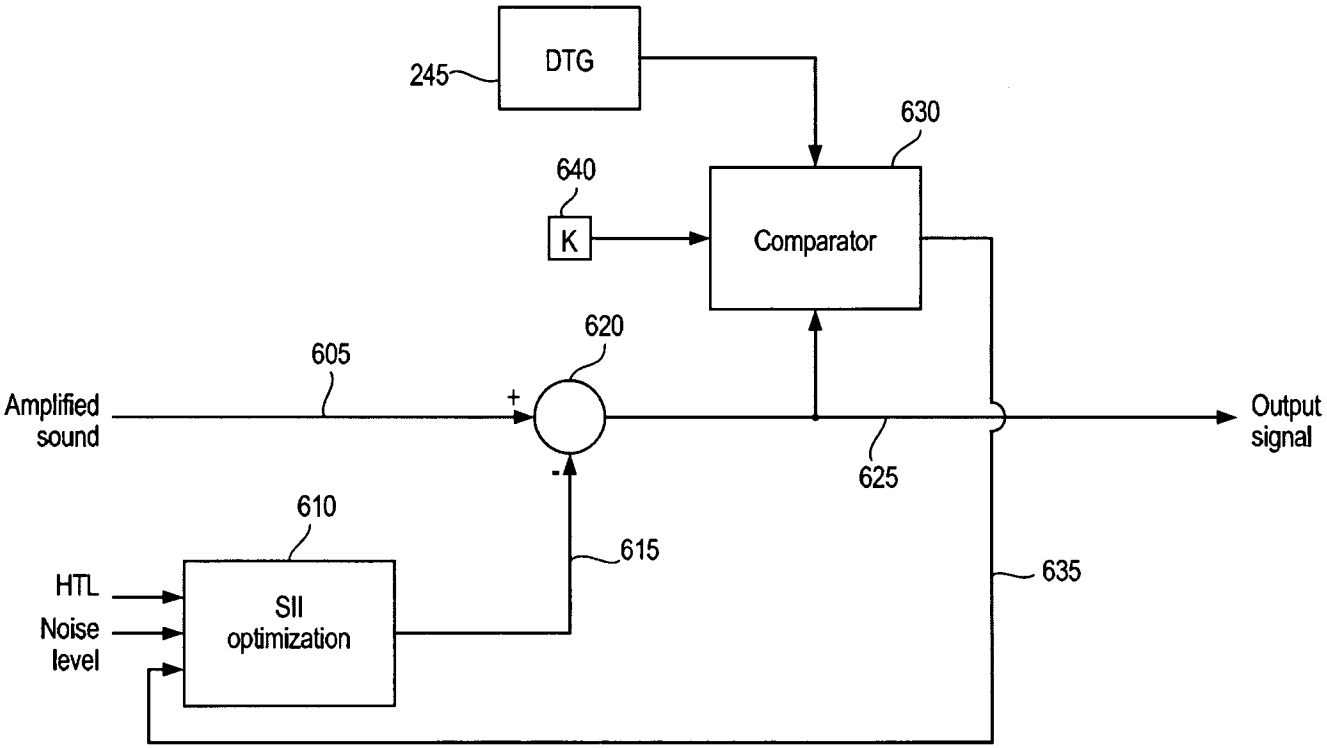
FIG. 6 depicts a block diagram of part of a hearing aid according to an embodiment of the present invention.

Reference is now made to FIG. 6, which shows a part of a hearing aid 300 according to another embodiment of the present invention.

SII optimization block 610 as means for optimizing a speech intelligibility index produces the SII gain 615, which is fed to the combiner or summation block 620, where the signal 615 is subtracted from the amplified sound signal 605 produced by the signal processor or compressor by applying the hearing aid gain. The output of the combiner may be considered as the noise reduced output signal 625 fed to the output transducer and also fed to the comparator 630. The comparator 630 compares the noise reduced output signal 625 plus the safety margin k in block 640 with the direct transmitted sound according to the DTG in block 245, both also supplied to the comparator. If the level of the noise reduced output signal plus the safety margin k is at or below the DTG, the comparator produces an error signal 635 which is fed to the SII optimizer 610 as a further input parameter which is taken into account during optimization of the SII so that the noise reduced output signal will not be attenuated below the threshold anymore in order to avoid phase disruption.

In a modified embodiment the hearing aid comprises a band-split filter for converting the input signal into band-split input signals of a plurality of frequency bands and the hearing aid is adapted to process the band-split input signals in each of the frequency bands independently.

According to embodiments of the present invention, systems and hearing aids described herein may be implemented on signal processing devices suitable for the same, such as, e.g., digital signal processors, analogue/digital signal processing systems including field programmable gate arrays (FPGA), standard processors, or application specific signal processors (ASSP or ASIC). Obviously, it is preferred that the whole system is implemented in a single digital component even though some parts could be implemented in other ways—all known to the skilled person.

Hearing aids, methods, systems and other devices according to embodiments of the present invention may be implemented in any suitable digital signal processing system. The hearing aids, methods and devices may also be used by, e.g., the audiologist in a fitting session. Methods according to the present invention may also be implemented in a computer program containing executable program code executing methods according to embodiments described herein. If a client-server-environment is used, an embodiment of the present invention comprises a remote server computer, which embodies a system according to the present invention and hosts the computer program executing methods according to the present invention. According to another embodiment, a computer program product like a computer readable storage medium, for example, a floppy disk, a memory stick, a CD-ROM, a DVD, a flash memory, or another suitable storage medium, is provided for storing the computer program according to the present invention.

According to a further embodiment, the program code may be stored in a memory of a digital hearing device or a computer memory and executed by the hearing aid device itself or a processing unit like a CPU thereof or by any other suitable processor or a computer executing a method according to the described embodiments.

Having described and illustrated the principles of the present invention in embodiments thereof, it should be apparent to those skilled in the art that the present invention may be modified in arrangement and detail without departing from such principles. Changes and modifications within the scope of the present invention may be made without departing from the spirit thereof, and the present invention includes all such changes and modifications.

The invention claimed is:

1. A hearing aid comprising at least one microphone, a signal processing means and an output transducer, wherein said signal processing means is adapted to receive an input signal from the microphone, wherein said signal processing means is adapted to apply a hearing aid gain to said input signal to produce an output signal to be output by said output transducer, and wherein said signal processing means further comprises means for calculating a direct transmission gain for the hearing aid and for adjusting said hearing aid gain according to said direct transmission gain, wherein said means for adjusting said hearing aid gain is adapted to adjust said hearing aid gain to a value not below said direct transmission gain.

2. The hearing aid according to claim 1, wherein said means for adjusting said hearing aid gain comprises means for applying dynamic noise reduction techniques.

3. The hearing aid according to claim 1, wherein said means for adjusting said hearing aid gain comprises means adapted to optimize a speech intelligibility index to produce a set of frequency dependent speech intelligibility index gain values for each time sample of said input signal.

4. The hearing aid according to claim 1, wherein said means for adjusting said hearing aid gain provides a safety margin and is adapted to adjust said hearing aid gain to a value not below said direct transmission gain plus said safety margin.

5. The hearing aid according to 3, wherein said means for calculating a speech intelligibility index is adapted to calculate a speech intelligibility index gain as a function of a plurality of input parameters.

6. The hearing aid according to claim 5, wherein said input parameters comprises at least one of a frequency dependent hearing threshold level, an estimated noise level, and an estimated speech level.

7. The hearing aid according to claim 3, wherein said means for adjusting said hearing aid gain is adapted to calculate a noise reducing hearing aid gain from an initial hearing aid gain and said optimized speech intelligibility index gain, and to adjust said noise reducing hearing aid gain to a value not below a threshold level.

8. The hearing aid according to claim 7, wherein said means for adjusting said hearing aid gain is adapted to detect the level of said noise reducing hearing aid gain before adjustment and, if said noise reducing hearing aid gain would be below said threshold level, to input said noise reducing hearing aid gain before adjustment as a further input parameter to said means for calculating a speech intelligibility index.

9. The hearing aid according to claim 4, wherein said safety margin is a gain value in the range of 0 to 15 dB, preferably in the range of 5 to 15 dB, particularly in the range of 5 to 8 dB, and more preferably 7 to 8 dB.

10. A method of reducing noise in a hearing aid comprising at least one microphone producing an input signal, a signal processing means producing an output signal from said input signal, and an output transducer outputting said output signal, wherein said method comprises:

calculating a direct transmission gain calculated for said hearing aid and its user;

storing said transmission gain in a memory of said hearing aid; and applying a hearing aid gain to said input signal to produce said output signal, wherein said hearing aid gain is adjusted by said direct transmission gain so that said hearing aid gain is not set to a value below said direct transmission gain.

11. The method according to claim 10, wherein said step of adjusting said hearing aid gain comprises the step of applying dynamic noise reduction techniques.

12. The method according to claim 10, wherein said step of adjusting said hearing aid gain comprises calculating a speech intelligibility index gain reducing the noise in said output signal and adjusting said hearing aid gain by said speech intelligibility index gain.

13. The method according to claim 10, wherein said step of adjusting said hearing aid gain comprises optimizing said speech intelligibility index to produce a set of frequency dependent speech intelligibility index gain values for each time sample of said input signal.

14. The method according to claim 12, wherein said speech intelligibility index gain is calculated with said direct transmission gain as a constraint to ensure that said hearing aid gain is not set to a value below said direct transmission gain.

15. The method according to claim 10, wherein said hearing aid gain is not set to a value below said direct transmission gain plus a safety margin.

16. The method according claim 12, comprising the step of converting said input signal into band-split input signals of a plurality of frequency bands and wherein said method is further carried out for each of said frequency bands.

17. A system of reducing noise in a hearing aid comprising means for reducing noise in a hearing aid comprising at least one microphone producing an input signal, a signal processing means producing an output signal from said input signal, and an output transducer outputting said output signal, said system comprising:

means for calculating a direct transmission gain calculated for said hearing aid and its user means for storing said transmission gain in a memory of said hearing aid; and means for applying a hearing aid gain to said input signal to produce said output signal, wherein said hearing aid gain is adjusted by said direct transmission gain so that said hearing aid gain is not set to a value below said direct transmission gain.

18. A computer program product containing a non-transitory computer readable medium with executable program code which, when executed on a computer, executes a method of reducing noise in a hearing aid comprising at least one microphone producing an input signal, a signal processing means producing an output signal from said input signal, and an output transducer outputting said output signal, wherein said method comprises:

calculating a direct transmission gain calculated for said hearing aid and its user storing said transmission gain in a memory of said hearing aid; and applying a hearing aid gain to said input signal to produce said output signal, wherein said hearing aid gain is adjusted by said direct transmission gain so that said hearing aid gain is not set to a value below said direct transmission gain.

* * * * *